United States Patent [19]

Ibrahim

[11] Patent Number: 4,593,908

[45] Date of Patent: Jun. 10, 1986

[54] GEOMETRIC PUZZLE

[76] Inventor: Baky B. Ibrahim, 11496 Drop Rd., North Huntingdon, Pa. 15642

[21] Appl. No.: 390,194

[22] Filed: Jun. 21, 1982

[51] Int. Cl.[4] ..... A63F 9/08

[52] U.S. Cl. ..... 273/153 S

[58] Field of Search ..... 273/153 S

[56] References Cited

U.S. PATENT DOCUMENTS 4,378,117 3/1983 Rubik ..... 273/153 S

FOREIGN PATENT DOCUMENTS

G8108498 9/1981 Fed. Rep. of Germany ... 273/153 S 170062 12/1977 Hungary ..... 273/153 S

OTHER PUBLICATIONS

Scientific American, Jul. 1982, pp. 19 and 20.

*Primary Examiner*—Anton O. Oechsle

*Attorney, Agent, or Firm*—Harry B. Keck

[57] ABSTRACT

A movable block geometrical puzzle having eight core pieces and having rotatable pyramid pieces connected to plane surfaces formed by surfaces of at least two of the core pieces. The block puzzle employs the 2×2×2 configuration for the core blocks and exhibits the same movements of the 2×2×2 puzzle, i.e., movement of any one block along with three other blocks about any of three mutually perpendicular axes passing through the center of the device. In addition, the present puzzle device provides rotatable movement of pyramid blocks about an axis which is perpendicular to the plane surface to which the pyramid blocks are secured and provides for movement of the pyramid blocks along with the supporting core block or blocks when the core blocks are moved relative to other core blocks. Connection means for core blocks of 2×2×2 puzzle are provided along with connection means for pyramid blocks of the present puzzle.

4 Claims, 14 Drawing Figures

GEOMETRIC PUZZLE

BACKGROUND OF THE INVENTION

1. Field of the Invention

The invention concerns a geometric puzzle and more particularly a puzzle having blocks which are movable about a common focus. More particularly this invention concerns a modified 2×2×2 block puzzle having additional movable blocks which are secured in groups to groups of the 2×2×2 block puzzle.

2. Description of the Prior Art

Geometrical puzzles of the type known as a "Rubik's Cube" have achieved outstanding commercial success. The Rubik's Cube comprises a 3×3×3 cubical block having 26 visible blocks and having six exposed faces, each face having nine exposed square block surfaces. In the Rubik's Cube, the central square of each face is permanently, pivotally connected at the end of the three mutually perpendicular mounting axes which intersect at the geometric center, or focus, of the cube. The movement of a Rubik's Cube involves nine of the blocks on any one face or eight central blocks between opposed faces. The object of the Rubik's Cube puzzle is to restore a predetermined block arrangement after the face blocks have been randomly arranged.

A related geometric puzzle is the 2×2×2 cube having eight blocks and having six exposed faces, each face having four square block surfaces. The movement occurs by rotating all four blocks on one side of a central plane. In a 2×2×2 geometrical puzzle, one of the eight blocks is rigidly secured to a central spherical core and the other seven blocks are slidably retained by appropriate connections to the spherical core. The 2×2×2 geometrical puzzle has the same object as the Rubik's Cube 3×3×3 puzzle, namely, to restore a pre-determined block arrangement after the face blocks have been randomly arranged.

The popularity of the 3×3×3 cube and the 2×2×2 cube puzzles suggests that perhaps more complicated geometric puzzles are desirable to challenge puzzle enthusiasts and to provide beneficial learning experiences.

STATEMENT OF THE INVENTION

The present invention employs the 2×2×2 block geometrical puzzle as a core for more elaborate and dificult geometric puzzles which, in two preferred embodiments, can be a 12-pointed star or an equilateral octahedron (also called a regular octahedron). In the 12-pointed star embodiment, none of the eight core blocks of the 2×2×2 core are visible. In the equilateral octahedron embodiment, one small surface, an equilateral triangle surface, of each of the eight core blocks is visible at all times. The present invention departs significantly from the cubic geometrical puzzles of the prior art by using core blocks which are not cubes, but instead are formed with triangular surfaces. In the 12-pointed star embodiment, the core blocks of the 2×2×2 core structure have the appearance of a tetrahedron defined by three such triangular outer surfaces. In the equilateral octahedron embodiment, each core block of the 2×2×2 core structure has four such triangular outer surfaces of which a central surface is an equilateral triangle and the other surfaces are right angle isosceles triangles having a base corresponding to a side edge of the equilateral triangle.

Abutting surfaces of the core blocks of the 2×2×2 core structure in each embodiment are coplanar and serve as a mounting surface for pyramid blocks. Where the coplanar surface is formed from two abutting core block surfaces, two pyramid blocks are pivotally connected with that surface and comprise, as a pair, one of the 12 points of the 12-pointed star embodiment. In the equilateral octahedron embodiment, a right angled isosceles triangle surface from four of the core blocks are in a common plane and defining a coplaner square surface to which four pyramid blocks are secured. Only one surface of each pyramid distal block is visible, to wit, an equilateral traingle surface.

To avoid confusion, each of the eight blocks which correspond to the 2×2×2 device will be identified as a core block. In the 12-pointed star embodiment, the core blocks will be "inner" core blocks and the pyramid blocks will be "outer" blocks. In the equilateral octahedron embodiment, these core blocks will be "interior blocks" and the pyramid blocks will be "exterior" blocks.

Two alternative connection systems are provided which are applicable to the 2×2×2 puzzle cube in its known form as well as in the new forms of this invention. In one embodiment, each of the core blocks has an inner surface which, adjacent to the core block perimeter, is a portion of a spherical surface. Each core block has an inwardly extending central portion. An undercut groove is provided beneath the edges of the central portion. The outer surface of the undercut groove corresponds to the spherical surface. A core member has six orthogonal radial arms, each having a cap at its outer end. Each of the caps is engaged by two of the undercut grooves of abutting core blocks. One of the core blocks is secured to the core member.

In the other embodiment, each core block has an inner partial spherical surface which is provided with circular grooves. When the eight core blocks are assembled, their combined inner surfaces comprise a first spherical surface. A core member is a sphere corresponding to the said first spherical surface. The core member has seven pegs or knobs, each of which is positioned at a corner of the included cube of the sphere. The pegs are adapted to be engaged within the circular grooves of the core blocks. The circular grooves of the core blocks are in the circles of intersection of the spherical surface and the six planes which are defined by the surfaces of the included cube of the spherical surface.

The present invention permits movement of core blocks which may be normally invisible to the operator or which may be partly visible to the operator in selected groups about rotational axes extending through the geometric center of the device. Movement of the core blocks is combined with movement of pyramid blocks, there being no relative movement between a core block and a pyramid block during the movement of the core blocks. In addition, the pyramid blocks may be rotated with respect to the subjacent core blocks whereby two or more pyramid blocks are independently moved with respect to the remainder of the device.

The geometrical puzzle is completed by providing a predetermined block arrangement of the visible faces of the puzzle. The visible block portions may be provided with distinctive colors, textures, or visible legends (numbers, letters, symbols) as desired by the puzzle designer or user. Distinctive colors or patterned markings are preferred.

DESCRIPTION OF THE PREFERRED EMBODIMENTS

Figure 1:
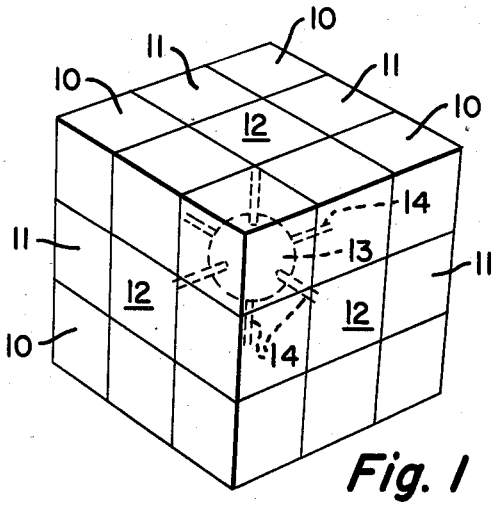
Fig. 1 Prior Art
FIG. 1 is a perspective illustration, partly in phantom, of a 3×3×3 cube geometrical puzzle of the prior art.

The nature of the cubic geometric puzzles of the prior art should be fully appreciated before discussing the improvements which have been achieved in the present invention. Referring to FIG. 1, there is illustrated a prior art 3×3×3 cubical geometrical puzzle having eight corner blocks 10, twelve side blocks 11 and six central blocks 12. Each of the corner blocks 10 has three exposed square surfaces at all times. Each of the side blocks 11 has two exposed surfaces at all times. Each of the central blocks 12 has one exposed surface at all times. Within the cube puzzle is a core member 13 having six supporting struts 14 each extending radially from the geometric center of the cube. Two of the struts 14 extend at 180 degrees from one another and are pivotally secured at their outer ends to opposing central blocks 12. The other pairs of struts are arranged with axes which are mutually perpendicular (orthogonal) to the other axes and are secured at their ends to opposed central blocks 12. In the 3×3×3 cube puzzle, the central blocks 12 are at all times maintained in the same relative position with respect to one another. The central blocks 12 are capable of rotation about the connected strut 14 and are capable of no other movement with respect to the five other central blocks.

The 3×3×3 puzzle has two different types of movement. One type of movement involves rotating a complete surface, that is, four corner blocks 10, four side blocks 11 and the included central block 12. The other type of movement involves four central blocks 12 and the included four side blocks 11. Each of these two movements, of course, can be accomplished about each of the three mutually perpendicular axes. Thus the number of permutations of arrangement of the 3×3×3 cube is quite large.

A similar geometric puzzle known as the 2×2×2 cube has eight blocks 16, each of which has three exposed surfaces at all times. One of the eight blocks 16 is securely connected to a central core member 17 and the other seven blocks are connected to the central core member 17 in a manner which permits them to slide over the spherical surface of the core member 17. The 2×2×2 cube in FIG. 2 has only a single movement, i.e., any four of the blocks 16 which form a common face can be rotated as a group of four blocks about an axis perpendicular to that face, the axis extending through the geometric center of the cube. Inasmuch as there are three mutually perpendicularly axes, any one of the blocks 16 can be moved in three different directions from its existing position. Each of those three different movements can be clockwise or counterclockwise.

The objective of the prior art cubic geometrical puzzles is to provide a challenge to the puzzle operator to restore a predetermined block arrangement which usually presents a color-identifiable pattern.

Figure 2:
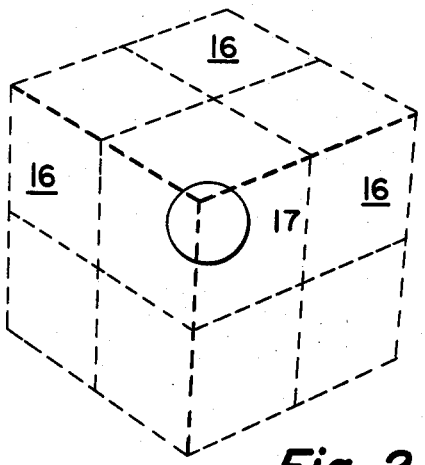
Fig. 2 Prior Art
FIG. 2 is a perspective illustration, partly in phantom, of a 2×2×2 cubical geometrical puzzle of the prior art.

It is also known in the prior art to change the overall appearance of the geometric puzzles of FIG. 1 and FIG. 2 from a cubic appearance to a multisurfaced appearance by cutting selected exposed surfaces. For example, in the 2×2×2 puzzle of FIG. 2, each of the blocks can have its corner cut so that the resulting puzzle appears to have many facets although there are only eight blocks and the resolution of the puzzle is unchanged. It is also known with the 3×3×3 puzzle to cut the corners of the blocks and apply a number or letter or other symbol to the resulting triangular corner face to give a still different appearance to the 3×3×3 puzzle. It is further known to round off all of the exterior blocks so that the cubic puzzle has a spherical appearance but the resolution of the puzzle remains unchanged. Similarly the 3×3×3 puzzle can have an altered appearance by cutting off corners of the corner blocks 10 or by cutting off the corner blocks 10 and adjoining portions of the side blocks 11. The structure can be rounded to a spherical shape by cutting corner, side and central blocks as desired. Despite the altered shapes, the resolution of the puzzle remains unchanged inasmuch as all of the components and the movements are unchanged.

Figure 3:
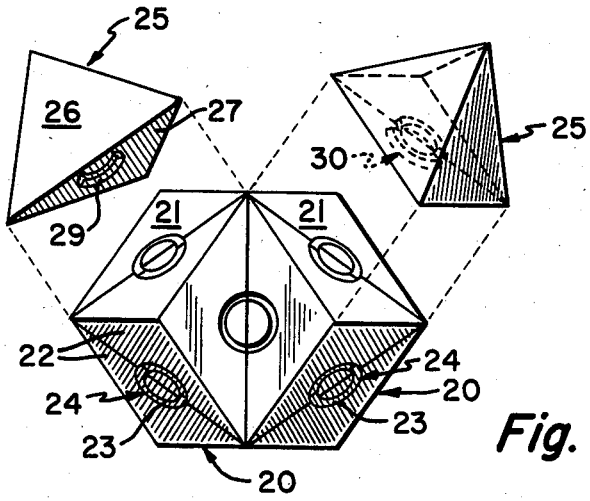
FIG. 3 is a perspective, exploded illustration of the core of the present geometrical puzzle for producing the 12-pointed star embodiment.
Figure 4:
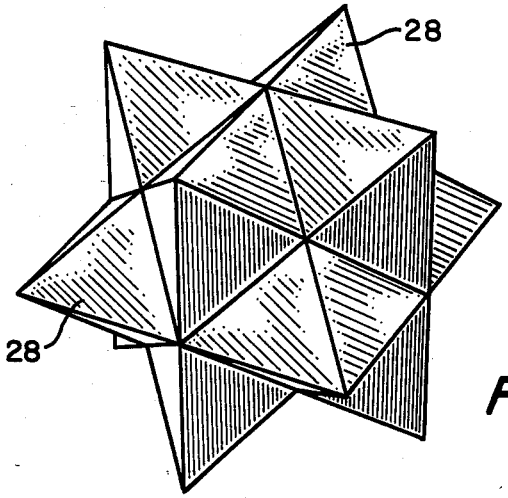
FIG. 4 is a perspective illustration of the 12-pointed star puzzle of this invention.

In one embodiment illustrated in FIGS. 3 and 4, a 12-pointed star puzzle employs eight inner core blocks 20, each of which is secured for movement about a core member to which one of the eight core blocks is secured. The inner core blocks are movable about a common focus in combination with three other ones of said inner core blocks, two of which are contiguous therewith and one of which is non-contiguous therewith. The exterior surfaces of the inner core blocks 20 are three isosceles triangle surfaces 21. It will be observed that two contiguous inner core blocks 20 have coplanar triangular surfaces 21 which form a diamond-shaped, coplanar surface 22. There are twelve such diamond-shaped surfaces 22. Each of the isosceles triangle surfaces 21 has a connection means 23 which combines with a corresponding connection means 23 of the other coplanar triangular surface to form a connection means 24 at the center of each diamond-shaped surface 22.

A pair of outer pyramid blocks 25 is provided, each having a first isosceles triangle surface 26 and a second isosceles triangle surface 27 together with two exposed triangular surfaces 28 (seen in FIG. 4). The surfaces 26, 27 are perpendicular to each other. A pair of the outer pyramid blocks 25 is formed and attached to the inner core blocks 20 by aligning the triangular surfaces 26 of each outer pyramid block 25 with the underlying diamond-shaped surface 22. Each outer pyramid blocks 25 has a connecting means 29. The two connecting means 29 combine to form a connecting means 30 which cooperates with the connecting means 24 of the inner core blocks 20 to secure two outer pyramid blocks 25 on each of the diamond-shaped surfaces 22.

In the 12-pointed star as shown in FIG. 4, it will be appreciated that only the outer surfaces 28 of the outer pyramid blocks 25 are visible. None of the inner core blocks 20 are visible. Similarly none of the connecting means 23, 24, 29, 30 are visible. The puzzle of FIG. 4 can be moved by rotating four inner core blocks 20 on one side of a plane which extends through the geometric center of the device. With this motion, the four moving inner core blocks will change their orientation with respect to the other four inner core blocks. From any of the puzzle positions, any core block can be rotated about any of the three mutually perpendicular radial axes of the puzzle. However all of the pyramid outer blocks 25 will, during this movement, retain their relationship with the supporting inner core blocks. As in the $2\times2\times2$ cube puzzle, the eight inner core blocks can be moved in groups of four about any one of the three mutually perpendicular axes of the device. The alternative movement which is available in the present invention is the rotational movement of a pair of pyramid outer blocks 25 on the supporting diamond-shaped surface 22.

The manner in which the pyramid outer blocks 25 are pivotally engaged with a diamond-shaped surface 22 of the inner core blocks 20 is not a restricting feature of this invention. A preferred means for connecting pyramid blocks to core blocks will be set forth hereafter. Tne pyramid block connection to core blocks can be applied to any of the embodiments of the invention.

The equilateral octahedron embodiment of the invention illustrated in FIGS. 5, 6, 7 will now be described. As shown in FIG. 6, the equilateral octahedron device 40 has eight surfaces 41, of which four are visible in FIG. 6. Each of the surfaces 41 has overall equilateral triangular shape and is formed from four smaller equilateral triangular surfaces 42, 43. The triangular surfaces 42 each have two of their edges comprising an outer edge of the equilateral octahedon 40. The central equilateral triangular surfaces 43 are bounded on three sides by edges of three equilateral triangluar surfaces 42.

Figure 5:
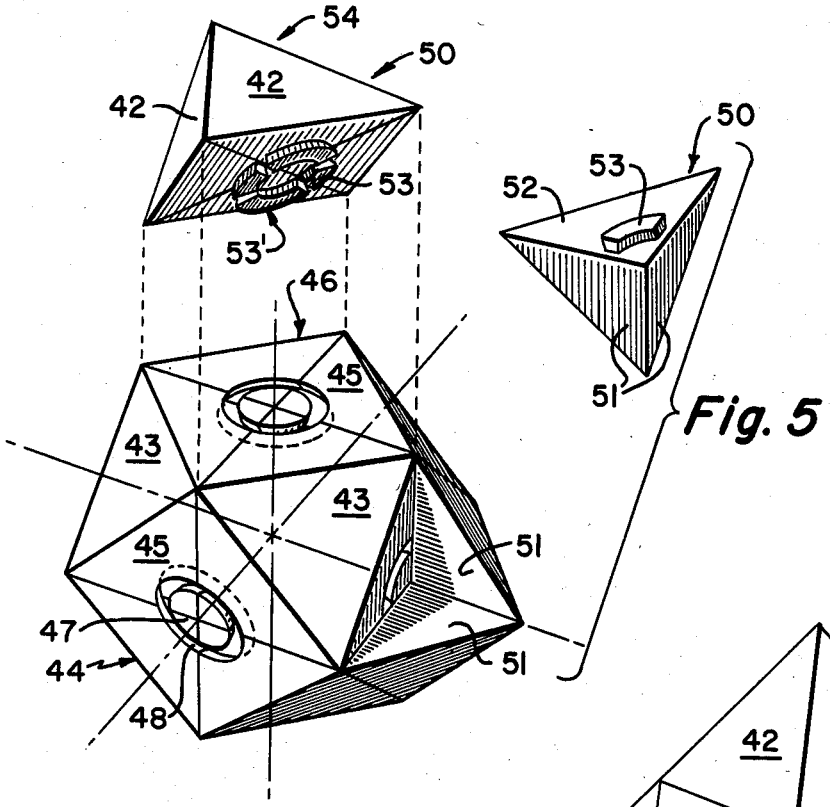
FIG. 5 is a perspective, exploded illustration of a core and pyramid block assembly for an equilateral octahedron geometrical puzzle according to this invention.
Figure 6:
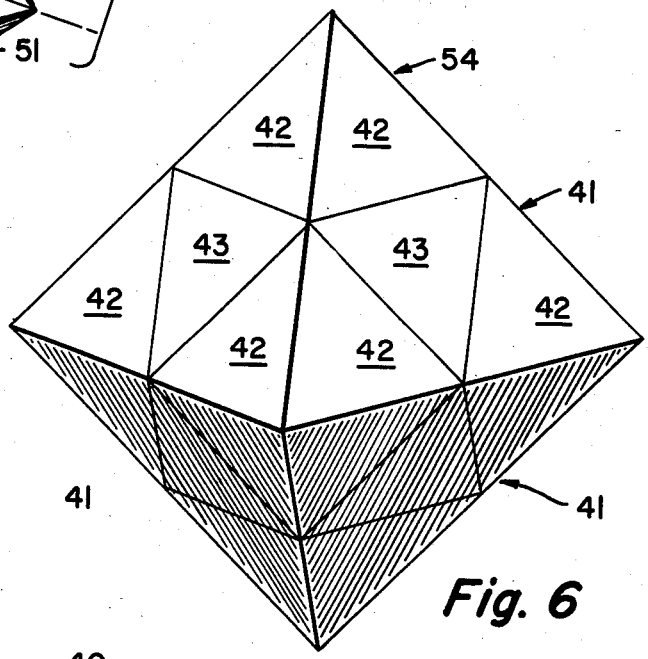
FIG. 6 is a perspective illustration of the equilateral octahedron puzzle of this invention.

The equilateral octahedron puzzle 40 is formed from eight similar interior core blocks 44, each of which is adapted to turn about a geometric center of the device as shown in FIG. 5. Thus each interior core block is movable about a common focus of the puzzle in combination with three other of said interior core blocks, two of which are contiguous therewith and one of which is non-contiguous therewith. Each of the interior core blocks 44 has an exposed surface comprising an equilateral triangle surface 43 and three isosceles right triangle surfaces 45. The equilateral triangle 43 is central to the three right isosceles triangle surfaces 45 and is at all times normal to a radial extending through the geometric center (focus) of the puzzle. The three isosceles right triangle surfaces lie in mutually perpendicular planes and each isosceles right triangle surface is pivotal to or perpendicular to a diametric plane of the puzzle. One of the eight interior core blocks 44 is securely connected to a central core member (not shown) and all of the remaining interior core blocks 44 are free to turn about the central core member in any of three available movements. The available movements for the core members 44 are the same as those for the $2\times2\times2$ cube puzzle and the 12 pointed star puzzle hereinabove described. That movement comprises rotation of four of the interior core blocks 44 on the same side of a diametric plane through the focus as a group about a rotation axis which is perpendicular to the diametric plane. The rotation axis may be any one of three mutually perpendicular axes extending through the geometric center (focus) of the device.

It will be observed from FIG. 5 that each of the interior core blocks 44 is positioned in such arrangement that there are six square surfaces 46, each formed by four coplanar right angle isosceles triangles 45. The edges of the square surface 46 are the base edges of four coplanar isosceles right triangle surfaces 45. Each square surface 46 is provided with a connection means 47 which itself is formed by the cooperation of connection means 48 associated with each right angle isosceles triangle surface 45. The puzzle has six square surfaces 46.

The device also includes twenty-four exterior pyramid blocks 50 each having mutually perpendicular three right angle isosceles surfaces 51, 51, 52. The surface 52 is provided with a connection means 53. The surfaces 51, 51 are engaged with a congruent surface 51 of other pyramid exterior blocks 50 to form a square base pyramid 54 having a square base which is congruent with the square surface 46 and having four congruent equilateral triangular surfaces 42 in a common plane. The connection means 53 of each pyramid exterior block 50 combine to form a connection means 53' which cooperates with connection means 47 to secure the square based pyramid 54 on a square surface 46. The exterior pyramid blocks are assembled in six groups of four blocks.

The exterior pyramid blocks 50 are mounted such that each individual pyramid block is secured to an interior core block in such fashion that any group of four exterior pyramid blocks can be rotated as an assembly about an axis of the puzzle which extends normally through the square surface 46 of the interior core blocks, the rotational axis also being coincident with the axis of the contiguous assembly of the four exterior pyramid blocks. Mounting means further permits movement of an abutting pair of the exterior pyramid blocks together with all of the other interior core blocks and exterior pyramid blocks which are on the same side of a diametric plane through the geometric center (focus) of the puzzle. This latter movement occurs as a rotation about an axis which is perpendicular to the diametric plane which separates the moving parts from the other parts of the puzzle. In this latter movement, there is no alteration of the relationship of any ones of the exterior pyramid blocks with respect to the contiguous ones of the interior core blocks.

It will be observed that after all of the twenty-four exterior blocks are connected, the equilateral octahedron puzzle has the appearance seen in FIG. 6 wherein the central equilateral triangular surfaces 43 are surfaces of the interior core blocks 44 and the remaining equilateral triangular surfaces 42 are surfaces of the pyramid exterior blocks 50. Only the surface 43 of the interior core block 44 is visible in the assembled puzzle. Only the single equilateral triangular surfaces 42 of each of the twenty-four exterior pyramid blocks 50 are visible.

Figure 7:
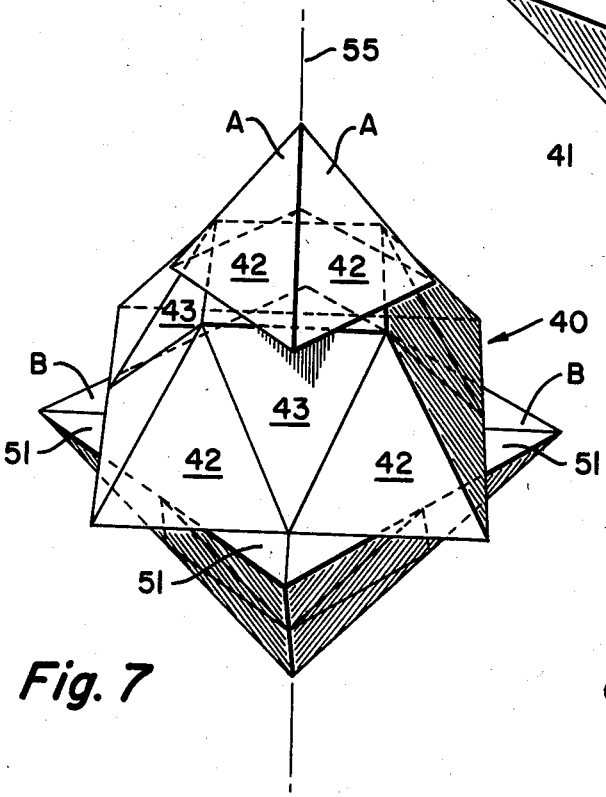
FIG. 7 is a perspective illustration showing the two movements which are typical of the movements which can be obtained in the equilateral octahedron geometrical puzzle.

The equilateral octahedron puzzle of FIGS. 5, 6, 7 can be moved in two different types of movements as shown in FIG. 7. There the four pyramid exterior blocks labeled A can be rotated as a group about a rotational axis 55 which passes through the geometric center of the device 40. This rotational movement can be accomplished independently of the remainder of the device 40. As a result of this rotational movement, any one of the four pyramid exterior blocks A can be aligned with a selected one of the supporting inner core blocks on the surface 45. The alternative movement is also illustrated in FIG. 7 wherein all of the components above a plane B which extends through the geometric center of the device 40 can be rotated about a rotational axis which is perpendicular to the plane B, namely about the axis 55 in FIG. 7.

During the actual movement of the components of the puzzle, it is possible to view some of the normally hidden surfaces of the device, for example, portions of the surfaces 51 and portions of the surfaces 45.

Connections of the Blocks

The present geometrical puzzle can be assembled in a variety of ways. In general there are connections between core blocks and some form of a core structure and there are connections between pyramid blocks and core blocks. The connections between core blocks and a core structure certainly can include connections which are known in the prior art 2×2×2 puzzles. The connections between pyramid blocks and core blocks are not heretofore known in the art. A preferred form of connection between pyramid blocks and core blocks is shown in cross-section in FIG. 8.

Figure 8:
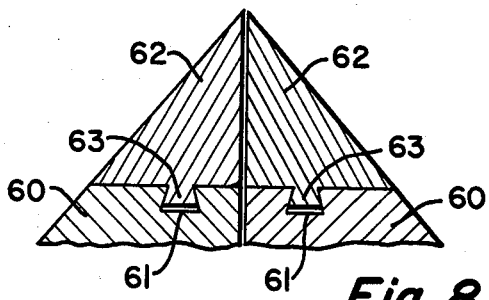
FIG. 8 is a section taken through two pyramid blocks and two core blocks illustrating a preferred connection means.

Referring to FIG. 8, core blocks are identified by the numeral 60 and may comprise either an inner core block 20 of a 12-pointed star puzzle (FIG. 3) or an interior core block 44 of an equilateral octahedron (FIG. 5). The core block 60 is connected to a core structure (not shown in FIG. 8). Each core block 60 has a semi-circular groove 61 which is wider at its base than it is at its throat. Pyramid blocks 62 may comprise the outer pyramid blocks 25 (FIG. 3) of the 12-pointed star embodiment or may comprise exterior pyramid blocks 50 (FIG. 5) of the equilateral octahedron embodiment. The pyramid blocks 62 have a quarter circular bead 63 which is wider at its crest than at its base. Each of the beads 63 is engaged in a groove 61. The bead 63 or the groove 61 or both are fabricated from resiliant material to permit a pressed-fit engagement. Each pyramid block 62 is free to rotate through a circular locus defined by the bead 63 and groove 61.

If desired, appropriate spring loaded ball members may be included in the core block 60 or the pyramid block 62 or both to maintain a smooth movement for the component blocks and to fix the position of the parts after completion of any movement, e.g., a detent position.

Figure 9:
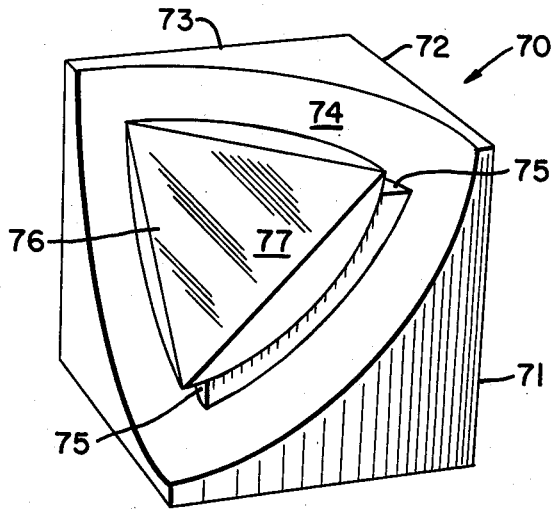
FIG. 9 is a perspective illustration of the interior surface of a core block of a geometrical puzzle according to one embodiment of this invention.
Figure 10:
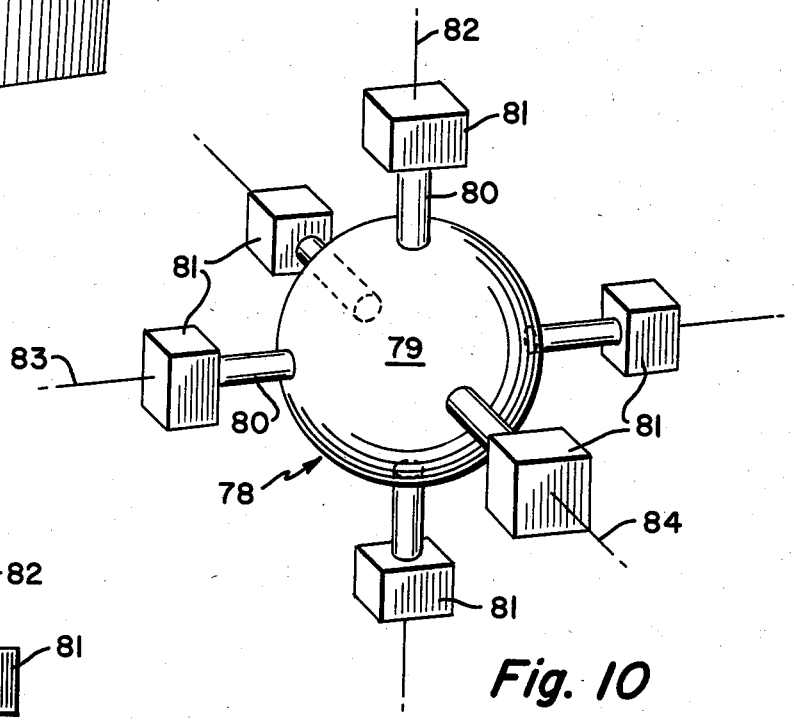
FIG. 10 is a perspective illustration of a core member useful in securing core blocks of this invention.

Improved connections for the core blocks are illustrated in FIGS. 9 through 11 and 12 through 14. In FIG. 9, the interior surface of a core block 70 is illustrated. The essential cubical nature of the block 70 can be seen from its side edges 71, 72, 73. The inner portion of the core block 70 is removed providing a first spherical surface 74 with an arcuate undercut groove 75 beneath a three-sided, inner central section 76 having a second spherical surface 77. The core blocks 70 are intended to function with a core member of the type shown in FIGS. 10, 11. As shown in FIG. 10 the core member 78 includes a sphere 79 having a diameter corresponding to the second spherical surface 77. Six shafts 80 extend from the sphere 79 as radials from the geometric center of the sphere 79. Each of the shafts 80 has a cap 81 at its outer end. The caps 81 in FIG. 10 are shown as having a generally square cross-section although circular cross-sections and octagon cross-sections or other symmetrical cross-sections can be employed. The caps 81 have a thickness corresponding to the thickness of the undercut groove 75 (FIG. 9). The shafts 80 are positioned with two each in alignment and each aligned pair disposed perpendicularly to the line of the other two aligned pairs.

Figure 11:
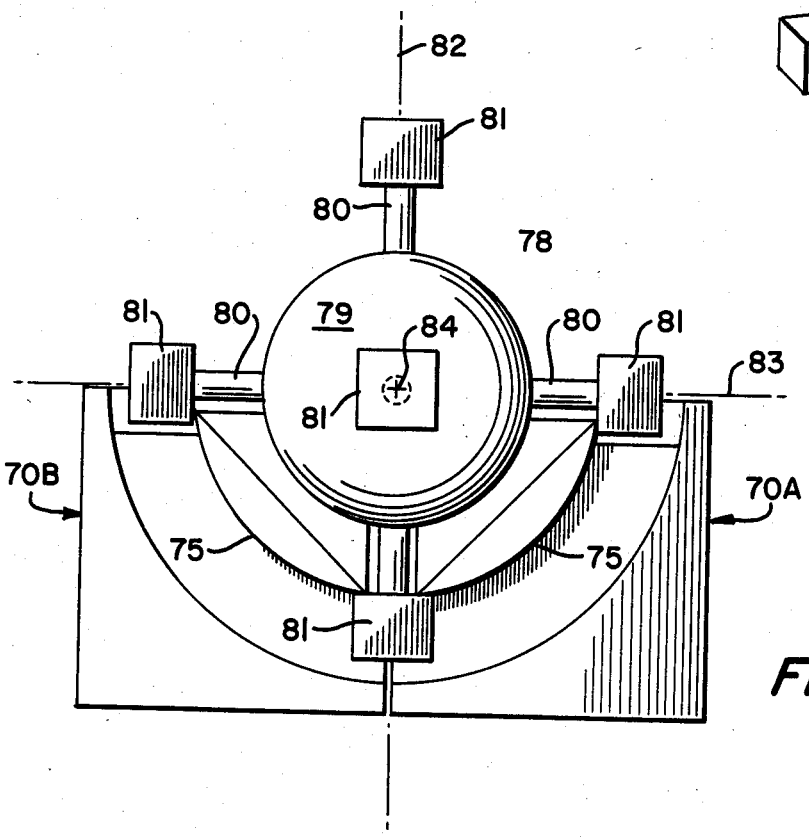
FIG. 11 is an illustration of two core blocks of FIG. 9 held by the core member of FIG. 10.

The assembly of the core member 78 and two of the inner core blocks 70 is shown in FIG. 11. The two core blocks 70 have the caps 81 engaged in the undercut groove 75. The shafts 80 are aligned in three perpendicular axes 82, 83 and 84 (which extends out of the plane of the drawing). The core block 70A can turn about the axis 82 or 84 along with the core block 70B; or the core block 70A can turn about the axis 83 while the block 70B remains fixed with respect to the core member 78. In the embodiment illustrated in FIGS. 9, 10, 11, one of the core blocks 70 is firmly and rigidly secured with respect to the core member 78.

While the core member 78 is illustrated as including a sphere 79, it is apparent that the core member 78 could be constructed from the rods 80 without having a central sphere 79. A core member constructed in this fashion, i.e., without a central sphere 79, is within the scope of the invention. The central section 76 would not require a spherical configuration for the surface 77 in this alternative embodiment.

Figure 12:
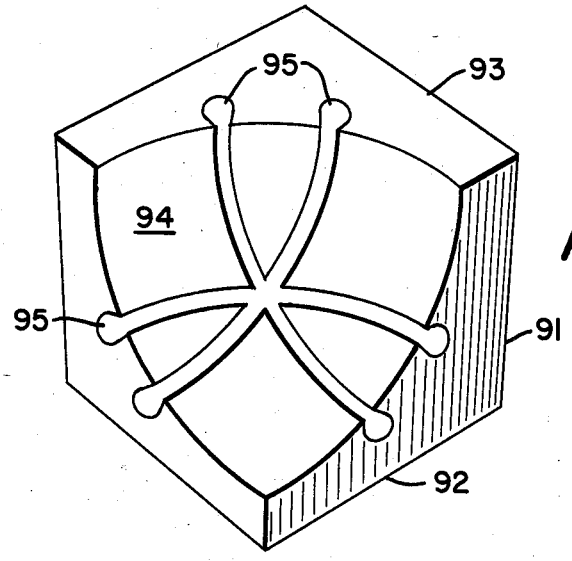
FIG. 12 is a perspective illustration of the interior surface of a core block in accordance with an alternative embodiment of this invention.
Figure 13:
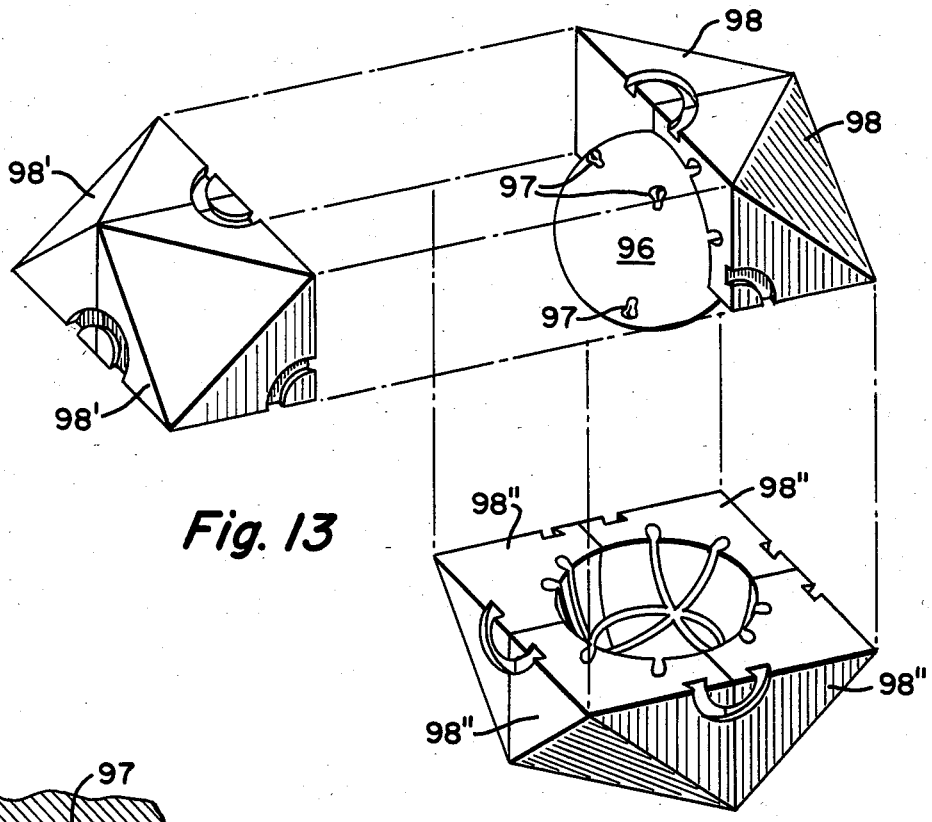
FIG. 13 is an exploded view showing a core member and means for slidably securing the core blocks of FIG. 12 to a core member.
Figure 14:
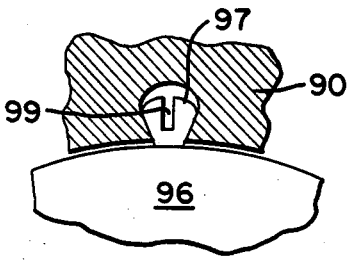
FIG. 14 is a fragmentary view partly in section showing a preferred connection means for a core member and core blocks according to this invention.

An alternative core assembly is illustrated in FIGS. 12, 13, 14 wherein each of the core blocks 90 has a side edge 91, 92, 93. The core block 90 is shaped at its inner surfaces to provide a spherical surface 94 having plural surface grooves 95 which are circular arcs along these mutually perpendicular planes passing through the center of the spherical surface 94. Each of the grooves 95 is wider at its base than at its throat. A central core member 96 in this embodiment comprises a sphere having seven pegs or knobs 97 positioned in selected alignment along six circular loci which are the six circles defined by intersections of the surface of the sphere 96 with the planes of the six surfaces of an inscribed cube of the sphere 96. The pegs or knobs 97 are adapted to be retained by the grooves 95. In one embodiment, as shown in FIG. 14, the peg or knob 97' has a central slot 99 which permits it to compress and enter into the groove 95' of a core block 90. Thereby the core block 90 is retained in radial relation to the sphere 96. Each of the core blocks 90 has at least one of the pegs or knobs 97 engaged with its grooves 95 at any one instant. When movement is completed, each of the seven pegs or knobs 97 is presented at an intersection of three of the grooves 95. One of the interior core blocks 98 is permanently secured to the sphere 96.

As shown in FIG. 13, two interior core blocks 98 of an equilateral octahedron device are engaged with the sphere 96. Thereafter two additional inner core blocks 98' can be connected to the sphere 96. Thereafter four additional interior core blocks 98" can be engaged with the sphere 96 to complete the core assembly for the equilateral octahedron device. One of the interior core blocks 98 is rigidly secured to the sphere 96 and experiences no relative movement whatsoever with respect to the sphere 96. All of the other interior core blocks 98, 98', 98" are adapted to slide about the spherical surface 96 relative to the one interior core block 98 which is rigidly connected to the sphere 96.

I claim:

1. In a geometrical puzzle having a core of eight similar core blocks each of which is movable about a common focus in combination with three other ones of said core blocks, two of which are contiguous therewith and one of which is non-contiguous therewith, the improvement comprising:

each said core block having an exposed portion with plane surfaces of which at least three said surfaces cooperate each with at least one similar surface of another one of said core blocks to define a plane surface having radial symmetry and being normal to an axis passing through said focus;

plural groups of similar pyramid blocks pivotally engaged with each said plane surface; mounting means for each of said pyramid blocks permit rotation of each said group of pyramid blocks about an axis which is normal to said plane surface; said mounting means further permitting rotation of four of said core blocks about any of three mutually perpendicular radial axes of said device without moving any of said pyramid blocks relative to the abutting core blocks;

said device having an overall radially symmetrical shape.

2. In a geometrical puzzle having a core of eight similar inner core blocks each of which is movable about a common focus in combination with three other ones of said inner core blocks, two of which are contiguous therewith and one of which is non-contiguous therewith, the improvement comprising:

each said inner core block having three triangular surfaces which define a tetrahedron shape having its axis of symmetry passing through said focus, each of said three triangular surfaces of each inner core block being coplanar with a contiguous triangular surface of an abutting one of said inner core blocks and defining therewith a diamond shaped surface; said device including twelve such diamond shaped surfaces;

a pair of similar outer pyramid blocks pivotally engaged with each said diamond shaped surface; mounting means for each of said outer pyramid blocks to permit rotation of each said pair of outer pyramid blocks on one said diamond shaped surface; said mounting means further permitting rotation of four of said inner core blocks about any of three mutually perpendicular radial axes of said device without moving any of said outer pyramid blocks relative to the abutting inner core blocks;

said device having the overall appearance of a twelve-pointed star.

3. In a geometrical puzzle having a core of eight similar interior core blocks each of which is movable about a common focus in combination with three other ones of said interior core blocks, two of which are contiguous therewith and one of which is non-contiguous therewith, any four of such interior core blocks on one side of a diametric plane through said focus being rotatable as a group about a rotation axis which is perpendicular to the said diametric plane, the improvement comprising:

each said interior core block having four triangular outer surfaces including a central equilateral triangular outer surface which is at all times normal to a radial extending through said focus; the remaining three outer surfaces comprising right angle isosceles triangles having a base corresponding to the side edge of the said equilateral triangle, said right angled isosceles triangles lying in mutually perpendicular planes and each being parallel to or perpendicular to said diametric plane;

each of said right angle isosceles triangles being coplaner with the isosceles triangles of two contiguous and one non-contiguous ones of said inner core blocks whereby four of said isosceles triangles define a square surface having sides which are base edges of the said four of said isosceles triangles;

the said eight inner core blocks comprising an inner core having six of said square surfaces and eight of said equilateral triangular surfaces;

twenty-four exterior pyramid blocks each having an equilateral, triangular exposed base congruent with the said equilateral triangular surface and having three mutually perpendicular right angle isosceles triangle surfaces each congruent with a said right angle isosceles triangular surface of each said interior core block;

said exterior pyramid blocks being assembled in groups of four with one of the said right angled isosceles triangle surfaces of each of the said four exterior pyramid blocks being in a common plane such that the right angles are inwardly positioned and such that the remaining two right angle isosceles triangle surfaces are engaged with a corresponding right angle isosceles triangle surface of an abutting one of said exterior pyramid blocks;

each assembly of four said exterior pyramid blocks having a square inner surface congruent with the said square surface of the assembled interior core blocks;

mounting means for each of said exterior pyramid blocks to secure the exterior pyramid blocks to interior core blocks and to permit rotation of each assembly of four said exterior pyramid blocks about an axis of the device extending normally through the said square surface of the interior core blocks and coincident with the axis of the contiguous assembly of four exterior pyramid blocks and also to permit movement of a pair of abutting ones of said exterior pyramid blocks together with all of the other interior core blocks and exterior pyramid blocks on the same side of a diametric plane through the said focus, said movement being a rotation about an axis which is perpendicular to the said diametric plane, said movement being completed without altering the relationship of any of the ones of said exterior pyramid blocks with respect to the contiguous ones of said interior core blocks;

the overall device comprising an octahedron having eight equilateral triangular faces, each formed from four individual equilateral triangular surfaces of which one is an interior core block surface and three are exterior pyramid block surfaces.

4. A connection for a 2×2×2 geometric puzzle comprising eight core blocks including seven movable core blocks and one fixed core block and a core member, said core member comprising a sphere having seven radially extended pegs, one each at seven of the eight corners of the inscribed cube of said sphere;

said core member being secured to said core block;

each said movable core block having a spherical inner surface corresponding to the said sphere and having three circular arc grooves, each adapted to engage any one of said pegs, said grooves being in the circle of intersection of said sphere and the six surfaces of the included cube of said sphere.

* * * * *